US005476388A

United States Patent [19]

Rutkowski

[11] Patent Number: 5,476,388

[45] Date of Patent: Dec. 19, 1995

[54] CONNECTOR BLOCK

[75] Inventor: John A. Rutkowski, Jackson, N.J.

[73] Assignee: AT&T Corp., Murray Hill, N.J.

[21] Appl. No.: 264,286

[22] Filed: Jun. 23, 1994

[51] Int. Cl.[6] ..... H01R 13/00

[52] U.S. Cl. ..... 439/76.1; 439/404; 439/676

[58] Field of Search ..... 439/403, 620, 439/76, 676, 493, 405, 404

[56] References Cited

U.S. PATENT DOCUMENTS

| | | | |
|---|---|---|---|
| 3,611,264 | 10/1971 | Ellis, Jr. | 439/404 X |
| 3,798,587 | 3/1974 | Ellis, Jr. | 439/405 |
| 4,286,835 | 9/1981 | Adams et al. | 439/493 |
| 4,894,024 | 1/1990 | Debortoli et al. | 439/76 X |
| 4,964,812 | 10/1990 | Siemon et al. | 439/403 |
| 5,061,209 | 10/1991 | Bolick, Jr. et al. | 439/676 |
| 5,228,872 | 7/1993 | Liu | 439/76 X |
| 5,310,363 | 5/1994 | Brownell et al. | 439/676 |

FOREIGN PATENT DOCUMENTS

| | | | |
|---|---|---|---|
| 8303717 | 10/1983 | WIPO | 439/76 |

*Primary Examiner*—William Briggs
*Attorney, Agent, or Firm*—Lester H. Birnbaum

[57] ABSTRACT

Disclosed is an electrical connector which includes a modular jack and 110-type connecting block. The connector may be installed directly to a 110-type index strip.

6 Claims, 2 Drawing Sheets

CONNECTOR BLOCK

BACKGROUND OF THE INVENTION

This invention relates to electrical connectors which may be included in standard telecommunication 110-type connecting systems.

The 110-type connecting apparatus is used throughout the telecommunications industry in order to electrically interconnect corresponding wires in two sets of wires. The first set is electrically coupled to an index strip which includes a row of teeth so that individual wires are secured between each adjacent tooth. A connector block which includes contacts having insulation displacement portions on both ends is brought down on the index strips to electrically contact the wires. The opposite ends of the contacts are enclosed by another set of teeth so that individual wires from the second set of wires can be inserted into the insulation displacement portions and thereby make electrical contact with corresponding wires from the first set (see, e.g., U.S. Pat. No. 3,798,587 issued to Ellis, Jr. et al.).

It has been proposed to employ a modular jack for connection to a 110-type interface (see U.S. Pat. No. 4,878,848 issued to Ingalsbe, and advertisement of Hubbell, *BICSI Newsletter,* Vol. 12, (Feb. 1992), pp. 6–7). It has also been proposed to combine a modular jack and 110-type insulation displacement contacts in a printed wiring board connector (see U.S. Pat. No. 5,091,826 issued to Arnett et al.).

However, it does not appear that the art has provided an integral modular jack and connecting block which can be coupled directly to an index strip on a 110-type connecting system.

SUMMARY OF THE INVENTION

The invention is a connector comprising a printed circuit board having two major surfaces. A modular jack is mounted to one major surface. A plurality of insulation displacement contacts are mounted to the board so as to extend from the opposite major surface and are electrically connected to the modular jack. The contacts are housed within an insulated housing with an end portion which is adapted for mechanically mating with an index strip.

BRIEF DESCRIPTION OF THE DRAWING

These and other features of the invention are delineated in detail in the following description. In the drawing.

It will be appreciated that, for purposes of illustration, these figures are not necessarily drawn to scale.

DETAILED DESCRIPTION

The connector 10 includes a modular jack 11 which is capable of receiving a standard modular plug (not shown) therein in an aperture 40 formed in one major surface thereof. The modular jack 11 includes a plurality of pins, e.g., 12, which are adapted to mate with pins in the standard modular plug.

Figure 3:
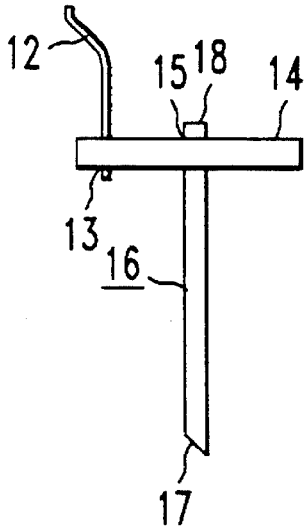
FIG. 3 is a side view of the portion of the connector of FIG. 2.

As more clearly seen in FIG. 3, each pin, e.g., 12, is mounted within an aperture, e.g., 13, formed through a printed circuit board 14. The apertures can be formed by standard laser drilling and plated through-hole technology. The board typically measures approximately 30.48 mm×12.7 mm and is approximately 1.57 mm thick.

Also mounted within apertures, e.g., 15, in the circuit board 14, is an array of contacts (e.g., 16) which extend away from the bottom surface of the board. The ends of the contacts opposite the board include an insulation displacement portion 17 which is capable of breaking the insulation surrounding a wire and providing electrical contact thereto. The contacts are similar to standard 110-type contacts except that only one end includes the insulation displacement portion and the other end includes a head 18 which is inserted in an aperture. The contact head, e.g., 18, is electrically coupled to a corresponding pin, e.g., 12, by a conductive lead, e.g., 19, which can be deposited by standard techniques on either the top or bottom major surfaces of the board 14. (Not all leads are shown for the sake of clarity in the illustration.)

Figure 1:
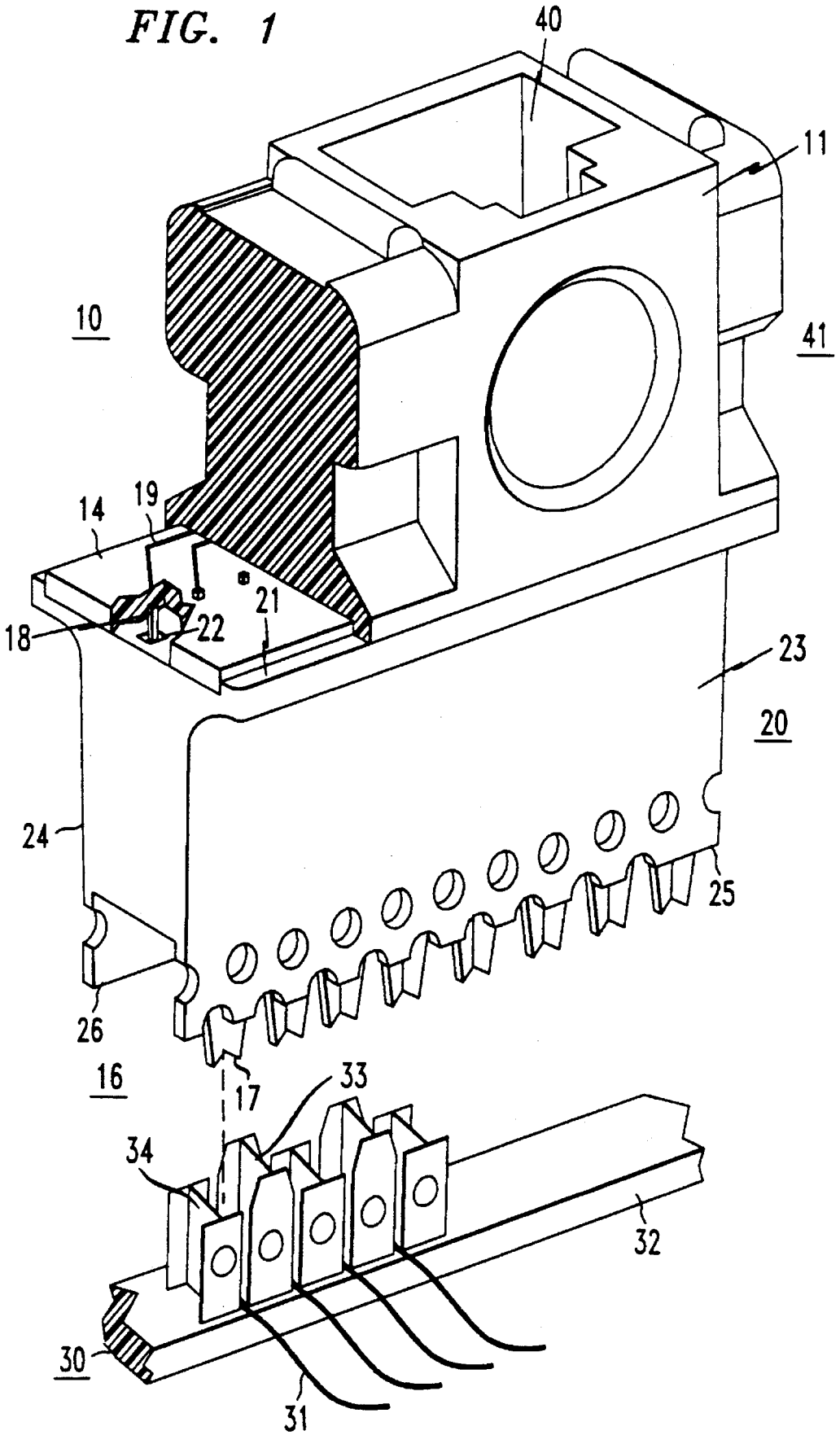
FIG. 1 is a perspective view of the connector according to one embodiment of the invention.
Figure 2:
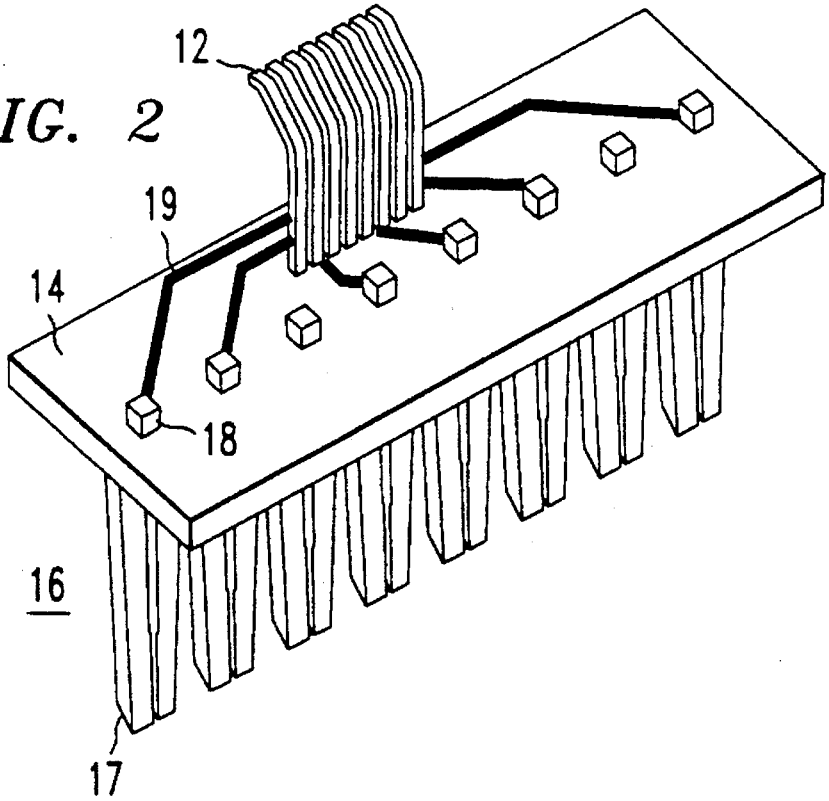
FIG. 2 is a perspective view of a portion of the connector in accordance with the same embodiment.

As best seen in FIG. 1, the contacts, e.g., 16, are mounted within an insulated housing 20, which is typically made of plastic. The housing 20 resembles a 110-type connector block except that it has an essentially flat upper surface 21 which in this embodiment is contoured to the shape of the board 14. The upper surface 21 also includes apertures, e.g., 22, through which the heads, e.g., 18, of the contacts protrude. The bottom surface of the housing is open to allow the contacts, e.g., 16, to extend therethrough. The two sides, 23 and 24, which are essentially parallel to the contact array have scalloped edges 25 and 26 which serve to hold the wires which will be contacted by the connector. The housing 41, including the modular jack 11, can be mechanically attached to the housing 20 by any number of techniques such as gluing, ultrasonic welding, or snap-fitting in order to enclose the top and bottom surfaces of the board 14.

As further illustrated in FIG. 1, the housing 20 and the contacts, e.g., 16, contained therein are adapted for mechanically mating with a standard index strip 30, and providing electrical connection to a set of wires, e.g., 31. The index strip 30 which is typically made of a molded plastic, includes a base member 32 and a plurality of "teeth", e.g., 33 and 34, extending up from the base.

Each wire, e.g., 31, to be electrically connected to the connector 10 is placed in the space between two adjacent teeth, e.g., 33 and 34. The connector 10 is pushed down onto the index strip so that the insulation displacement portion, e.g, 17, of each contact, e.g., 16, is inserted into a corresponding space between adjacent teeth, e.g., 33 and 34, and makes electrical contact with the corresponding wire in that space. At the same time, the ends of the side surfaces, 23 and 24, cover corresponding front and back surfaces of the teeth in order to protect the contacts and hold the wires in place.

Thus, the connector 10 is mechanically and electrically mateable with the standard 110-type index strip and the set of wires mounted therein.

Various modifications of the invention will become apparent to those skilled in the art. All such variations which basically rely on the teachings through which the invention has advanced the an are properly considered within the scope of the invention.

I claim:

1. A connector comprising:

a printed circuit board having two major surfaces;

a modular jack mounted to one major surface;

a row of insulation displacement contacts mounted to the board so as to extend from the opposite major surface of the board, said contacts being electrically connected to the modular jack; and an insulated housing enclosing at least a major portion of the contacts, said housing having an end portion with an opening therein through which the contacts promade and side surfaces at said end portion which are essentially parallel to the row of contacts, the contacts being adapted to fit within spaces between a row of teeth in a 110-type index strip including a plurality of wires therein so that the contacts make electrical contact with corresponding ones of said wires while the side surfaces are adapted to cover front and back surfaces of the teeth and mate with the index strip.

2. The connector according to claim 1 wherein the contacts have insulation displacement portions on only one end which extends from the circuit board, the opposite end of the contacts comprising head portions which are inserted within apertures in the circuit board.

3. The connector according to claim 1 wherein the modular jack comprises a plurality of conductive pins inserted within apertures in the circuit board, each pin being electrically connected to a corresponding insulation displacement contact.

4. The connector according to claim 3 wherein the pins are electrically connected to the contacts by conductive layers deposited on at least one surface of the board.

5. The connector according to claim 1 wherein the side surfaces have scalloped edges in order to hold the wires within the index strip.

6. The connector according to claim 1 wherein the modular jack includes a surface adapted to receive a modular plug, which surface is essentially parallel to the major surfaces of the circuit board.

* * * * *